US009814938B2

(12) United States Patent
Schaer et al.

(10) Patent No.: US 9,814,938 B2
(45) Date of Patent: Nov. 14, 2017

(54) PORTABLE DEVICE FOR INFLATING A BAG

(71) Applicant: RAS TECHNOLOGY SÀRL, Lignières (CH)

(72) Inventors: Marc-Antoine Schaer, Lignières (CH); Robert Graham, Nods (CH); Laurent Raeber, Neuchâtel (CH)

(73) Assignee: RAS Technology Sàrl, Lignières (CH)

( * ) Notice: Subject to any disclaimer, the term of this patent is extended or adjusted under 35 U.S.C. 154(b) by 30 days.

(21) Appl. No.: 14/770,562

(22) PCT Filed: Jan. 30, 2014

(86) PCT No.: PCT/EP2014/051787

§ 371 (c)(1),
(2) Date: Aug. 26, 2015

(87) PCT Pub. No.: WO2014/131565

PCT Pub. Date: Sep. 4, 2014

(65) Prior Publication Data

US 2016/0206924 A1 Jul. 21, 2016

(30) Foreign Application Priority Data

Feb. 28, 2013 (CH) ..... 525/13
Mar. 15, 2013 (CH) ..... 612/13
Jul. 2, 2013 (EP) ..... 13174811

(51) Int. Cl.
*A63B 29/02* (2006.01)
*A62B 33/00* (2006.01)
(Continued)

(52) U.S. Cl.
CPC ..... *A63B 29/00* (2013.01); *A62B 33/00* (2013.01); *A62B 99/00* (2013.01); *A63B 29/021* (2013.01); *B63C 9/1055* (2013.01)

(58) Field of Classification Search
CPC ..... A63B 29/00; A63B 29/021; A62B 33/00; A62B 99/00; B63C 9/1055
(Continued)

(56) References Cited

U.S. PATENT DOCUMENTS 4,566,862 A 1/1986 Halavais
4,627,822 A * 12/1986 Esposito ..... B63C 9/18 441/92
(Continued)

FOREIGN PATENT DOCUMENTS

EP 2 418 005 A1 2/2012
EP 2 548 619 A2 1/2013
(Continued)

OTHER PUBLICATIONS

International Search Report Corresponding to PCT/EP2014/051787 dated Sep. 8, 2014.
(Continued)

*Primary Examiner* — Nicolas A Arnett
(74) *Attorney, Agent, or Firm* — Davis & Bujold, PLLC; Michael J. Bujold

(57) ABSTRACT

A portable device for inflating an inflatable bag (60) comprises at least one inlet (46), for forming a fluid connection to a gas source. The gas source is attached or attachable to the inlet. The device further comprises an air intake chamber (32) which has an opening allowing atmospheric air to be admitted and an outlet intended to be connected to the bag to be inflated. The gas source comprises a first and at least a different second gas component. The first component is stored at least partially in liquid form; preferably, the first component is carbon dioxide. The gas source contains at least 10%, preferably more than 30% and most preferably more than 60% of the first component. The second component is gaseous or supercritical at a temperature of 243K and
(Continued)

up to a pressure of 200 bar, preferably, the second component has a critical temperature below 243K.

31 Claims, 6 Drawing Sheets

(51) Int. Cl.
*A63B 29/00* (2006.01)
*A62B 99/00* (2009.01)
*B63C 9/105* (2006.01)

(58) Field of Classification Search
USPC ..... 141/10, 37, 313; 116/210; 441/92
See application file for complete search history.

(56) References Cited

U.S. PATENT DOCUMENTS 5,988,438 A * 11/1999 Lewis ..... B63C 9/18 222/3
6,220,909 B1 4/2001 Aschauer et al.
6,270,386 B1 * 8/2001 Visocekas ..... A41D 13/018 441/104
6,860,205 B2 * 3/2005 Baker ..... B64D 25/14 102/530
7,270,077 B2 * 9/2007 Beck ..... A62B 33/00 116/209
7,878,141 B2 * 2/2011 Paynton ..... A62B 33/00 116/210
8,876,568 B2 * 11/2014 Blenkarn ..... A45F 3/04 116/210
9,272,187 B2 * 3/2016 Blenkarn ..... A45F 3/04
9,290,420 B2 * 3/2016 Schaer ..... C06D 5/02
9,427,625 B2 * 8/2016 Rose ..... B63C 9/155
9,731,801 B2 * 8/2017 Blenkarn ..... A45F 3/04
2008/0272579 A1 * 11/2008 Breed ..... B60R 21/205 280/728.2
2010/0184343 A1 * 7/2010 Paynton ..... A62B 33/00 441/90
2013/0019994 A1 1/2013 Schaer et al.
2015/0017851 A1 * 1/2015 Blenkarn ..... A45F 3/04 441/91
2016/0016045 A1 * 1/2016 Rose ..... B63C 9/155 441/114
2016/0144938 A1 * 5/2016 Blenkarn ..... A45F 3/04 441/91

FOREIGN PATENT DOCUMENTS

GB 1 149 004 4/1969
WO 2009/030234 A1 3/2009

OTHER PUBLICATIONS

Written Opinion Corresponding to PCT/EP2014/051787 dated Sep. 8, 2014.

* cited by examiner

PORTABLE DEVICE FOR INFLATING A BAG

TECHNICAL FIELD

The present invention relates to a portable device for rapidly inflating an inflatable bag such as, for example, an avalanche airbag.

The device according to the invention may comprise at least one inlet, preferably a first and a second inlet, representing a fixation for a sealed cartridge comprising compressed gas at high pressure, the inlet being associated with a mechanism that triggers the release of the compressed gas to an air intake chamber. The latter may have an opening allowing atmospheric air to be admitted and an outlet intended to be connected to the bag that is to be inflated.

BACKGROUND

Devices of this type have already been disclosed, for example in U.S. Pat. No. 6,220,909 B1. That document describes an avalanche airbag inflation device intended to operate notably using a cartridge of nitrogen compressed to 200 bar. The cartridge is assembled with a control mechanism that allows the gas to be released in response to a user action. The gas, once released following the piercing of the cartridge, is conveyed to two inflation mechanisms, by pipes, each inflation mechanism being associated with an inflatable bag.

The gas is injected into a cylindrical air intake chamber provided in each of the inflation mechanisms by an injection nozzle arranged substantially in line with the central axis of the air intake chamber. This chamber comprises a plurality of openings in its lateral wall so that atmospheric air can be sucked in in response to the injection of the high-pressure gas. The air sucked in is accelerated by a Venturi effect to inflate the corresponding inflatable bag quickly with a sufficient volume, by applying a multiplication factor (volume of air/volume of compressed gas) to that of the volume of compressed gas available, thanks to the addition of the air.

Each of the inflation mechanisms further comprises a nonreturn check valve to prevent the corresponding inflatable bag from becoming deflated via the inlet when it is fully inflated.

As an alternative to nitrogen, it is also known practice to use compressed air, which is a mixture of oxygen and nitrogen and some traces of other gases, as the compressed gas at high pressure.

In general, the multiplication factor applied in the known devices is not very high, of the order of 2 to 3 (which means that the volume of atmospheric air injected into the airbag is of the order of 2 to 3 times the volume that the gas represents in the airbag once it has expanded) and entails the use of a significant volume of compressed gas in order to be able to inflate the airbag.

The space occupied by the compressed-gas cartridge thus contributes significantly to the overall space occupied by the inflation device, and this is why the abovementioned US patent proposes a design of the device that comes in modular form, which means to say that allows the various component parts of the device to be located at different parts of a pack for example.

However, in that case, getting the device into or out of a backpack, for example, is a complicated matter because each of its component parts has its own means of attachment that have to be done up or undone.

It will also be noted that, aside from the requirement that has to be observed regarding the airbag inflation volume, it is absolutely essential that the airbag be inflated quickly. As a general rule, an avalanche airbag needs to be inflated in around 2 to 4 seconds, preferably in less than 5 seconds.

EP 258619 A2, discloses a device as herein described, comprising an intermediate distribution chamber for the compressed gas, which chamber may be arranged between the inlet and the air intake chamber in order to connect the one to the other, and a plurality of ejection holes arranged so as to open into a lateral wall of the air intake chamber in order to connect the latter to the intermediate distribution chamber.

By virtue of these features, the device can be used with carbon dioxide cartridges which were not useable with devices according to the state of the art. Further, said device is adapted for use with different gases, such as nitrogen.

Carbon dioxide is a gas which is highly compressible and can be stored in a liquid form, which means that a large potential volume of it can be stored in a cartridge of the kind frequently used in various applications. This is one of the reasons, aside from its low cost, why this gas is generally used for inflating lifejackets in vehicles of the boat or aeroplane type, for example.

However, the expansion of this gas consumes a great deal of energy, which causes it to cool rapidly as it expands and carries with it the risk of it freezing. The device as disclosed in foresaid application however makes it possible to avoid these difficulties which are specific to carbon dioxide and to harness all the advantages of its use with reference to the other gases.

As illustrated in a preferred embodiment of said former application, said device could have two inlets which allows the use of two cartridges with a small volume instead of one cartridge with a huge volume. The risk of freezing of the carbon dioxide was reduced.

The use of said device with carbon dioxide still might have some limitations, in particular depending on surrounding temperature. Indeed, with ambient temperatures of below 0° C., the viscosity of carbon dioxide increases. Such a high viscosity results in a slow release to the air intake chamber, resulting in a significant lengthening of inflation the airbag.

With ambient temperatures below −10° C., the expansion of carbon dioxide can cause freezing of the carbon dioxide and can lead to a malfunction of the device.

At this end, at least a partial risk of freezing remains, even in extreme conditions, particularly in ambient temperatures below −10° C. For temperatures below 0°, an effect of decelerating of the distribution of gas, and thus, decelerating of inflation of the inflating bag occurs.

In consequence, said known device reliably works in common ambient temperatures. However, it may not always reach a sufficiently reliable level in extreme conditions which maybe necessary for official certification.

SUMMARY

A main objective of the present invention is thus to provide an alternative embodiment to the known devices and/or to improve prior art embodiments. In particular, it is an objective to provide an embodiment for rapidly inflating a bag meeting the constraints described above, particularly for performing the inflation of an airbag in the required time, even in extreme conditions and still allowing the use of a small and lightweight cartridge.

To overcome said problems, the invention provides the use of a gas mixture of a first and a second component. A first component is provided by a gas which can be stored in liquid form under normal operating conditions, i.e. at temperatures between −30° C. and +40° C. and at pressures below 200 bar, preferably below 300 bar. Typically, under various applicable regulations, cartridges filled with a gas with such a pressure can be freely sold and used. The first component allows to store a large volume of gas in a small cartridge. A second component is provided by a gas which remains in the gaseous or supercritical form under the above conditions. The second gas functions as a transport gas since it has no tendency to freeze during expansion. It is typically possible to use carbon dioxide as a first component and argon or nitrogen as a second component, wherein said components are preferably in separate cartridges.

Thus, a configuration of avalanche safety devices as described herein will ensure the functionality over a broad range of temperatures and ambient conditions, such as e.g. humidity and partial air pressure. Particularly, such a device will work below ambient temperatures of less than −10°.

To this end, the invention relates more specifically to an inflation device of the type mentioned above, with at least one inlet, preferably a first and second inlet, for forming a fluid connection to a gas source. Said gas source is attached or attachable to said inlet. Further, the device comprises an air intake chamber which has an opening which allows atmospheric air to be admitted. The device comprises an outlet intended to be connected to the bag that is to be inflated. In one preferred embodiment, the first component is carbon dioxide and the second component is different from carbon dioxide. The gas source contains at least 10%, preferably more than 30% and most preferably more than 60% of carbon dioxide. The second component is in a gaseous phase or is a supercritical fluid at temperature of −30° and higher (i.e. above 243K) and at pressure up to 200 bar, preferably, the second component has a critical temperature below 243K.

According to the understanding in the technical field which belongs to the invention, amounts for gases are always volume amounts in standard conditions. In chemistry, IUPAC established standard temperature and pressure as a temperature of 273.15K (0° C., 32° F.) and an absolute pressure of 100 kPa (14.504 psi, 0.986 atm, 1 bar).

One advantage of such a gas source, containing at least two components is that, while using said device, that at least the second component stays in a gaseous state, even under extreme conditions. Such a device will work in temperatures until −30° (243K). For harder conditions, the second component may have a critical temperature below 223K.

The critical temperature is the temperature at the critical point of a substance. At and beyond the critical temperature, a liquid cannot be formed by an increase in pressure. At and beyond the critical temperature, the properties of its gas and liquid phases converge. The heat of vaporization is zero, and so no distinction exists between the gaseous phase and the supercritical phase.

Thus, a component, which has a critical temperature below 243K will, independent of the pressure, be in a gaseous or supercritical state.

According to another aspect of the invention, the gas source comprises substantially solely argon. It could be conceivable, to mix said argon with a second component different from argon to improve the inflating of the inflatable bag. A gas source with argon and a further component may contain more than 25%, preferably more than 45% and most preferably more than 95% of argon. In a preferred embodiment, the gas source comprises 35% of argon and 65% of carbon dioxide.

Argon has a critical temperature of around 150K. A device with a gas source which contains argon can be used in extremely hard conditions and will work highly reliably.

Another major advantage of such a device is the possibility to have a configuration which can be adjusted to specific conditions or can be optimized in view of costs and effort.

In a preferred embodiment, the second component can be nitrogen. Nitrogen has a critical temperature at around 120K.

It is also conceivable to have for example argon as a second component, if the first component is carbon dioxide. Oxygen or Helium or other inert gases are also conceivable as a second component. A mixture of more than two gases is also conceivable. Preferably, the second component is selected from the group consisting of nitrogen, argon, oxygen, helium or mixtures thereof such as dry air, which contains nitrogen, oxygen and argon and several other components. Air has a critical temperature of around 133K.

A carbon dioxide-nitrogen or argon configuration fulfils the requirement of preventing freezing of the device in case of use. For example, a configuration, wherein all second components have a critical temperature below 243K, such for example an argon-nitrogen configuration is also useful.

The use of a gas source with different gases or mixtures of gases decreases the multiplication factor in comparison to the use of a gas source which contains solely carbon dioxide. The fact, that in one preferred embodiment, one component of the gas mixture is carbon dioxide, ensures that the multiplication factor remains on a high level.

The second component, in particular the argon or nitrogen, stays gaseous even in extreme conditions, in particular in the conditions, when the device as herein described is used, the second component acts as a transporter gas from the region located in the central region of the device, in particular the region where the oblique channels are located, to the inflatable bag. In the case, when the carbon dioxide begins to freeze and to build solid particles, such particles will be carried and blown out by the transporter gas. This will prevent clogging of the device by frozen carbon dioxide.

In a preferred embodiment, the gas source is one or more gas cartridges. After the use of the device, a cartridge is easily changeable and the device will be ready for a next operation in a reasonable period.

In a useful configuration, the gas cartridge contains a mixture of said first and second component, particularly a mixture of carbon dioxide with a gas different from carbon dioxide, in particular, the second component is a gas with a critical temperature below 243K.

In an alternative embodiment, the first and second component of the gas is stored in separate gas cartridges. Naturally, such gas cartridges does not contain 100% of the same gas, they can contain traces of other gases, in accordance with the quality of the delivered gas. For example, helium for balloons contains at least 95% of Helium. The other 5% can be traces of other gases.

A configuration with first and second gas cartridges which include first and second components has the advantage, that the device can be equipped with conventional cartridges which are available on the market for different applications, e.g. safety vests on boats for CO2 and cartridges used in food processing for the second component.

In an alternative embodiment, first and second gas cartridges are filled with a gas mixture which contains first and second gas components.

For that case, that the gas source comprises substantially solely argon, it is also conceivable to have two cartridges, which were both filled with argon.

In a alternative embodiment, the device comprises at least one inlet which forms fixation means for a gas cartridge. The gas cartridge can be a sealed gas cartridge which contains gas at a high pressure. High pressure in the meaning of this application is more than 10 bar, preferably more than 50 bar and most preferred more than 100 bar. Typically, gas cartridges have pressures of around 200 bar. Said inlet is associated with a mechanism that triggers the release of said compressed gas to an air intake chamber. The air intake chamber has an opening allowing atmospheric air to be admitted and an outlet, which is intended to be connected to the bag that is to be inflated. The inlet is associated to the gas cartridge. The gas cartridge comprises a mixture of carbon dioxide and at least one transporter gas. A transporter gas is characterized in that the critical temperature is below 243K and or stays in a gaseous or supercritical state at a temperature of 243K and a pressure of around more than 200 bar. The transporter gas is different from carbon dioxide. Other mixtures are conceivable, such as argon or nitrogen with a transporter gas. The mixture is compressed under high pressure. Such a mixture is able to fulfill the specific requirements, based on the configuration of the device and/or ambient conditions. A specific composition of several gas components is possible.

In an alternative embodiment, the device comprises first and second inlets. Each of said inlets forms a fixation for a preferably sealed gas cartridge comprising a compressed gas at high pressure. Said inlet is associated with a mechanism that triggers the release of said compressed gas to an air intake chamber. Preferably, the mechanism triggers the release of each cartridge substantially simultaneously. Substantially simultaneous means, that triggering can also be made step by step without any major delay or gap in time. The air intake chamber has an opening allowing atmospheric air to be admitted and an outlet, which is intended to be connected to the bag that is to be inflated. The first inlet is associated to a carbon dioxide cartridge and the second inlet is associated to a cartridge with a transporter gas, such as nitrogen or argon. Such an embodiment enables a fast replacement of used cartridges. Such cartridges are readily available on the market.

According to these characteristics, such a configuration prevents the device during the use from freezing and thus, from malfunction. The path of the first gas component, in particular from the carbon dioxide, is kept clear by the transporter gas, which stays gaseous, even in extreme conditions, according to the properties of the gas. In the case, when the carbon dioxide begins to freeze and to build solid particles, such particles will be carried and/or blown out by the transporter gas. This will prevent a clogging of the device by frozen carbon dioxide. Thus, configuration of avalanche safety devices as described herein will ensure the functionality over a broad range of temperatures and ambient conditions, such as e.g. humidity and partial air pressure. Particularly, such a device will work below ambient temperatures of less than −10°.

In a preferred embodiment, the gas source comprises 10% to 95%, preferably 25% to 85% and most preferably 45% to 75% of carbon dioxide.

In a preferred embodiment, the gas source comprises 90% to 5%, preferably 75% to 15% and most preferably 55% to 25% of argon.

In an alternative embodiment, the gas source comprises 90% to 5%, preferably 75% to 15% and most preferably 55% to 25% of nitrogen instead of Argon.

Of course, the maximum value of a mixture of gases is 100%. Belonging to the amount of one component, the amounts of a second, third or further component in addition can only have the missing volume until 100%.

Said gases, or a mixture of said gases are preferably compressed by a pressure of at least 50 bar, preferably 100 bar and most preferably 200 bar. According to the volume of the volume of the inflatable bag, said gas source comprising gas with a standard volume, which is around 3 to 4 times smaller as the volume of the bag which has to be inflated. By the way of example, for an inflatable bag according to the present invention, which has a volume from about 150 liters, the standard volume of the gas source is between 30 and 50 liters, preferably between 35 and 45 liters. A preferred CO2-argon mixture contains 60 grams of CO2 and 25 grams of argon, which results in a volume of around 44 liters at standard conditions.

In a preferred embodiment, the device comprises an intermediate distribution chamber for said compressed gases. Said chamber is arranged between the inlet, in particular between said first and second inlets on the one hand and said air intake chamber on the other hand. The inlet, in particular the first and second inlets are in communication with the intermediate distribution chamber in such manner that said intermediate distribution chamber ensures a connection with the air intake chamber. Such a chamber allows the gas to be distributed in specific configuration to the air intake chamber.

Preferably, the device comprises at least one, preferably a plurality of ejection holes arranged so as to open into a lateral wall of said air intake chamber in order to connect the latter to said intermediate distribution chamber. It is also conceivable, to have a slot instead of a single hole.

Preferably, the intermediate distribution chamber may be at least partially annular in overall shape and may be arranged at the periphery of the intake chamber.

Such configuration enables the ejection of the compressed gas at the circumference of the air intake chamber and improves the effect of inflating the inflatable bag.

Furthermore, the lateral wall of the intake chamber into which the ejection holes open may be located between the opening and the outlet in particular, in a longitudinal direction of the device.

According to one preferred embodiment, the device may comprise a first cylindrical tube which defines the lateral wall of the intake chamber, and a second cylindrical tube, coaxial with the first tube and arranged at least partially around it in order to define the intermediate distribution chamber between them. At least two seals may be provided to delimit this chamber in an axial direction.

The first and second tubes may advantageously be joined together by screw-fastening or by a bayonet mechanism.

Such a design makes it possible to guarantee a simplified method of manufacturing the various component parts of the device, and for assembling or dismantling them, for example for servicing operations.

Moreover, the ejection holes may preferably be inclined more or less by between 10 and 20 degrees with reference to the longitudinal direction of the device, and preferably have a diameter more or less of between 0.2 and 1 mm, preferably between 0.5 and 0.8 mm.

The device may advantageously comprise between 2 and 10 ejection holes.

As a preference, the inlet may have an attachment member for attaching a sealed cartridge containing a compressed gas at high pressure. Further, the trigger mechanism may comprise a first needle controlled by a drive mechanism that a user can actuate so that it can move between at least a first position and a second position and pierce the sealed cartridge in order to release the compressed gas therefrom.

The attachment member may advantageously comprise a tapped thread that can be screwed-together with a male screwthread provided on the sealed cartridge.

Moreover, according to a preferred embodiment, the device may comprise a second inlet similar to the first inlet and intended to accept a second sealed cartridge of compressed gas and which is associated with an additional trigger mechanism comprising a second needle designed to be operated substantially at the same time as the first needle and to pierce the second sealed cartridge in order to release the compressed gas therefrom. Substantially simultaneous means, that triggering can also be made step by step without any major delay or gap in time.

Furthermore, it is also possible, as a preference, to plan that the intake chamber may comprise an acceleration cone arranged between the ejection holes and the outlet, preferably having a length more or less of between 60 and 150 mm.

Moreover, the device may advantageously comprise a reversible attachment member for reversible attachment to an inflatable bag, this member preferably being arranged at some distance from the outlet so that the acceleration cone can be at least partially housed in the inflatable bag in the use configuration.

The present invention also relates to an assembly comprising a device having the above described features and an inflatable bag.

The present invention also relates to the use of a gas cartridge comprising a gas mixture containing at least a first component, in particular carbon dioxide and a second component, in particular a gas which is gaseous or supercritical at a temperature of 243K and a pressure of 200 bar, preferably with a critical temperature below 243K in an avalanche safety system, particularly in an avalanche safety system which comprises a device as described herein for inflating an inflatable bag, for preventing a malfunction of the device, in particular for preventing freezing and/or clogging of the device.

The present invention also relates to the use of at least a first and a second gas cartridge containing different gases and/or a gas mixture, preferably a carbon dioxide or argon mixture with a further component which is gaseous or supercritical at a temperature of 243K and a pressure of 200 bar, preferably has a critical temperature below 243K, in an avalanche safety system, particularly in an avalanche safety system which comprises a device as described herein for inflating an inflatable bag, for preventing a malfunction of the device, in particular for preventing freezing and/or clogging of the device.

The present invention also relates to the use of argon in an avalanche safety system, particular in an avalanche safety system which comprises a device as described herein for inflating an inflatable bag, for preventing a malfunction of the device, in particular freezing and/or clogging of the device.

BRIEF DESCRIPTION OF THE DRAWINGS

Other features and advantages of the present invention will become more clearly apparent from reading the detailed description of a preferred embodiment which follows, given with reference to the appended drawings provided by way of nonlimiting examples and in which.

DETAILED DESCRIPTION

Figure 1:
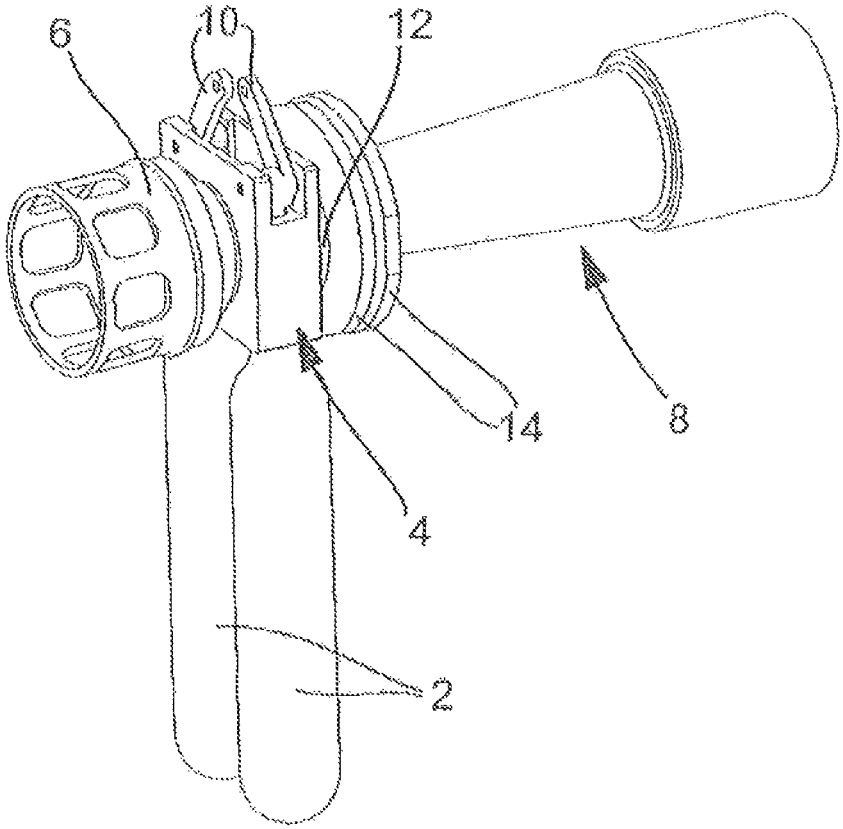
FIG. 1 is a simplified perspective view of a first embodiment of a portable device for the rapid inflation of an inflatable bag according to the present invention.

FIG. 1 depicts a simplified perspective view of a first embodiment of a portable device for the rapid inflation of an inflatable bag according to a preferred embodiment of the present invention. More specifically, the device illustrated is particularly well suited to rapidly inflating a bag of the avalanche airbag type and substantially corresponds to the device as disclosed in EP 2548619 A1.

Of course, the implementation of the disclosed invention is not limited to the specific construction as herein described. Several alternatives are possible to fulfil the requirement of a simultaneous expansion of the gases and/or the gas components into the air intake chamber, in particular for inflating an avalanche safety airbag.

The device of FIG. 1, of elongate overall shape, is designed to inflate an airbag using two sealed cartridges 2 of compressed gas.

According to the invention, one of said two gas cartridges contains carbon dioxide, while the other one contains argon.

Advantageously but without implying any limitation, the cartridge 2 may be a standard carbon dioxide cartridge, preferably containing 33 grams of carbon dioxide, at a pressure of the order of 200 bar and available more or less worldwide at a very modest cost. Such cartridges are actually generally used, for example, to inflate the lifejackets found on aeroplanes. Other cartridges and/or cartridges with different sizes, pressures and filling amounts can be used without leaving the scope of the invention.

The second cartridge can be of a similar type as the first and/or be of a standard type of cartridges as available on the market.

Bay way of example, for inflating an inflatable bag with a volume of 1501, one can use a first cartridge of carbon dioxide, with a volume of 85 ml, filled with 60 g of carbon dioxide and a second cartridge of argon, with a volume of 85 ml and containing 25 g of argon or a nitrogen cartridge, with a volume of 85 ml and containing 13 g of nitrogen. Such a configuration results in a mixture relation of around 65% of $CO_2$ and 35% of argon or 75% of $CO_2$ and 25% of nitrogen for standard conditions for temperature and pressure in the intermediate distribution chamber.

The cartridges 2 are assembled with a central body 4 of the device. The latter bears an air intake cylinder 6 on a first side and an air ejection tube 8 on the other side. It is preferable to position a filter, not illustrated, around the air intake cylinder 6 to prevent a large-sized element from blocking the latter.

Moreover, first and second levers 10 which are intended to be pivoted in response to an action by a user to release the compressed gas are assembled with the central body 4.

The central body 4 here has a threaded cylindrical support portion 12 onto which airbag retaining washers 14 (see FIG. 2) are screwed. A circular opening may be provided in the airbag into which to insert the air ejection tube 8 and one of the two washers 14, the other washer then being screwed against the first one in order to trap the periphery of the opening in the airbag, thereby immobilizing it.

Of course, a person skilled in the art will have no particular difficulty in implementing alternative means for attaching the inflation device to the airbag without departing from the scope of the invention.

Figure 2:
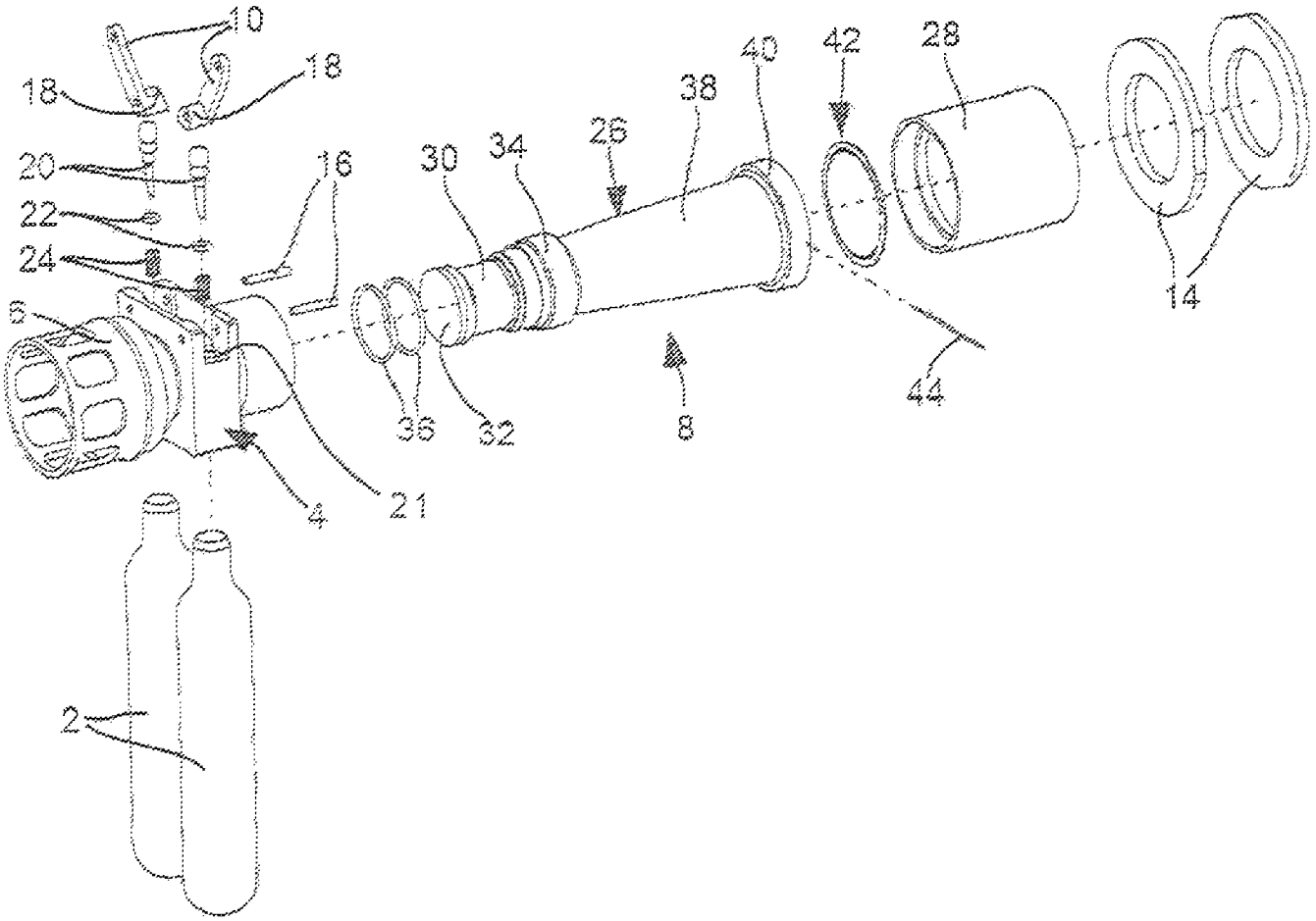
FIG. 2 is an exploded and simplified perspective view of the device of FIG. 1.

FIG. 2 is a simplified and exploded perspective view of the device of FIG. 1, providing a better understanding of its construction.

It is clear from FIG. 2 that the levers 10 are pivot-mounted on the central body 4 via rods 16.

Each lever 10 bears a cam 18, produced as one piece with the lever in this instance by way of illustration, and designed to act on a needle 20 mounted with the freedom to effect a translational movement in a matched bore 21 of the central body, with the interposition of a seal 22 and a spring 24, the functions of which will be explained later on.

The ejection tube 8 comprises a main first portion 26 intended to be screwed into the central body 4 and intended to support a cylindrical end portion 28 defining the outlet of the device into the airbag.

Figure 5:
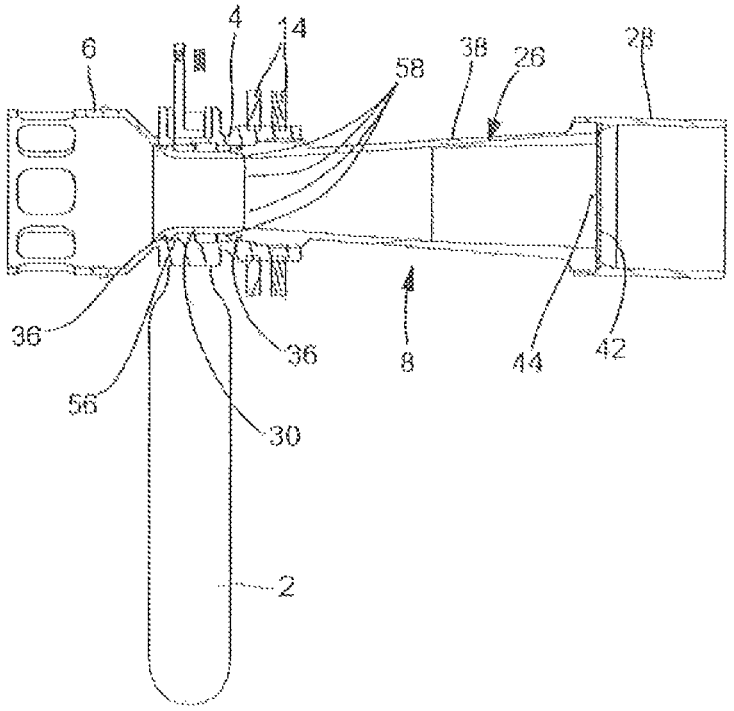
FIG. 5 is a simplified overall view in cross section of the device of FIG. 1.

The main portion 26 has a first part 30, of cylindrical overall shape, intended to define the inlet of an air intake chamber 32 at its centre and an intermediate distribution chamber in communication with the central body 4, as will become apparent from the detailed description of FIG. 5.

The first part 30 also has a male screwthread 34 so that it can be screwed into the central body, with the interposition of two seals 36 or O-rings, distant from one another in the longitudinal direction of the device.

A second part 38 extends the first and has a conical overall shape. The main function of this second part is to accelerate the air introduced via the inlet of the air intake chamber 32, by a Venturi effect, in the known way, so that it can be injected into the airbag and inflate the latter.

The second part 38 bears a cylindrical male screwthread 40 at the end of the large-diameter conical part, onto which the end portion 28 can be screw-fastened.

A non return membrane 42 is interposed between the second part 38 and the end portion 28 and is clamped between these two elements.

The nonreturn membrane here is produced in the form of a disc having a circular slot near its periphery extending over a little less than 360 degrees, so as to define a central disc held on the periphery by a thin tongue of material.

Thus, the central disc is able to pivot with respect to the peripheral portion in order to allow air to pass in one direction, but is blocked against the second portion 38 in the other direction in order to prevent the gas and the air from leaving the airbag.

The nonreturn membrane offers optimum dependability and robustness for a low number of components.

It will be noted that a thin rod 44 may be provided, in the second portion 38 as a safety measure, to define an end stop for the pivoting disc and prevent the nonreturn membrane from deforming in the airbag outlet direction, something which could happen if a high and sudden pressure were applied to it were such a stop not present.

Figure 3:
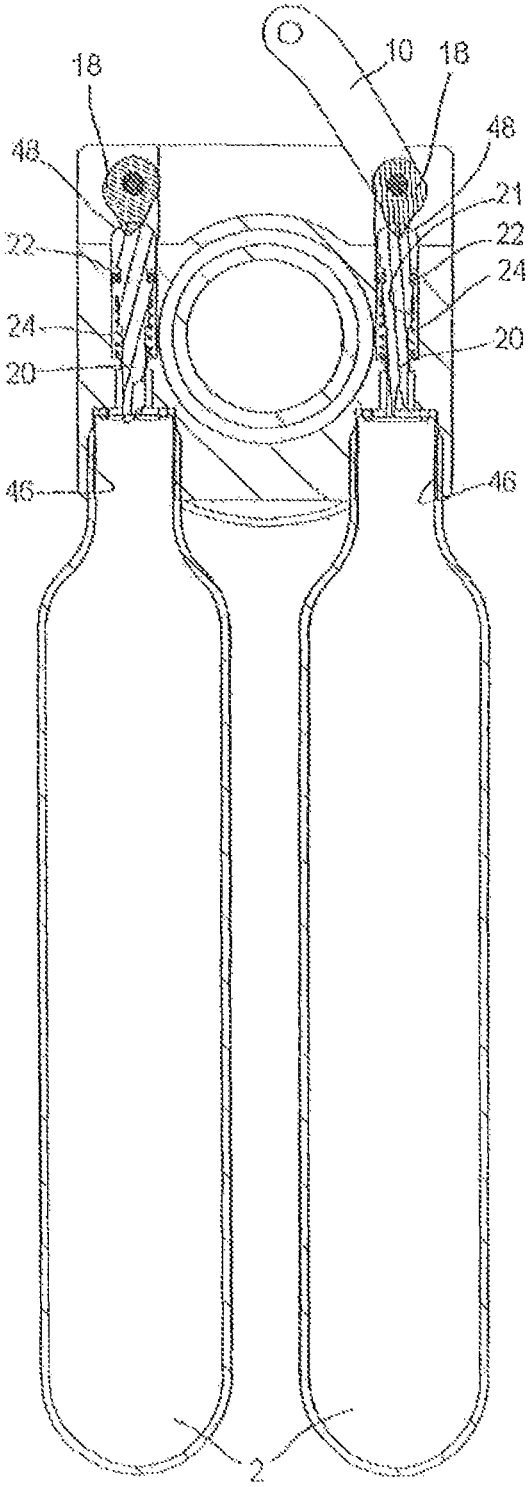
FIG. 3 is a simplified view in cross section of a detail of the construction of the device of FIG. 1.

FIG. 3 is a simplified view in cross section of a detail of construction oft the device of FIG. 1 and, more specifically, of the mechanism that triggers the release of the gas from the cartridges 2.

Each cartridge 2 is screwed to an inlet 46 of the inflation device, along the axis of movement of the needles 20. The needles are housed in matched bores 21.

Each cam 18 has a cam lobe 48 intended to apply pressure to the corresponding needle against the force of the spring 24 kept in abutment in the central body.

Thus, when the lever is pivoted, the cam lobe 48 pushes against the needle which pierces the corresponding gas cartridge in order to release the compressed gas. A seal 22 is shown, which prevents the gas from leaving the device, when the device is in function.

As the lever continues to turn in the direction for activating the device, the cam offers the needle a smaller diameter portion so that the needle can retreat and thus allow the gas to be released more quickly.

It will be noted that the levers 10 are mounted top to tail to limit the amount of torque applied to the device when a user activates it.

Figure 4:
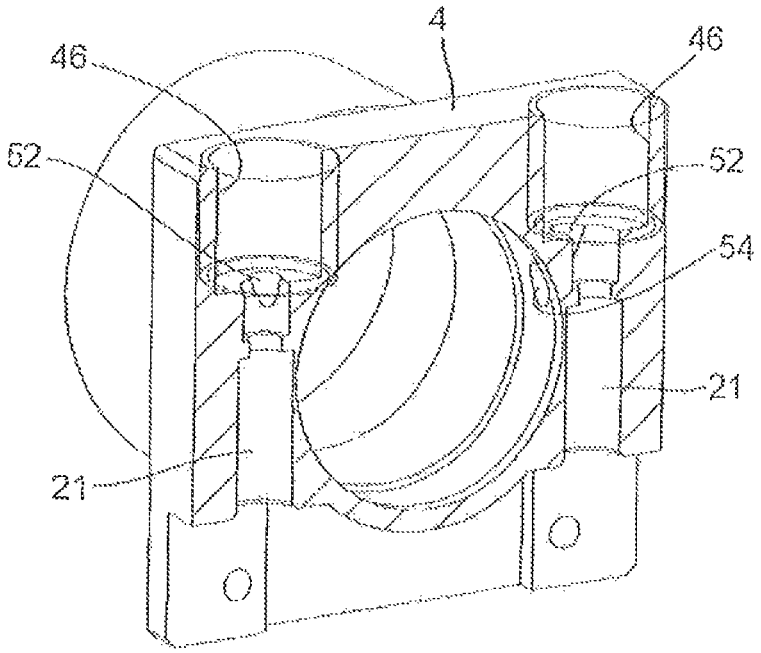
FIG. 4 is a simplified perspective view in partial cross section of a detail of the construction illustrated in FIG. 3.

FIG. 4 is a simplified perspective view in partial cross section of a detail of construction illustrated in FIG. 3, particularly of the central body 4, although for the sake of clarity, the mechanisms that trigger the release of the gas and the cartridges have not been depicted.

Each needle 20 (see FIG. 3) is housed in a matched bore 21 of the central body 4.

Recesses 52 are formed in the bore to allow the compressed gas to be released even if the needles remain in their depressed position. The bevelled shape of the needles offers an additional safety feature with regard to dependability.

Further, each bore communicates with the inside of the central body via an oblique passage 54 formed near the corresponding inlet 46. The simplicity of this construction means that it retains good durability.

FIG. 5 is a simplified overall view in cross section of the device of FIG. 1.

When the air ejection tube 8 is assembled with the central body 4, these two tubular elements between them define an annular cavity that forms an intermediate distribution chamber 56 for the compressed gas, into which chamber the oblique passages 54 (see FIG. 4) open. This intermediate chamber is delimited by the internal wall of the central body, the external wall of the first part 30 of the main portion 26 of the ejection tube, and the two seals 36, in the longitudinal direction of the device.

Ejection holes 58 are provided to cause the intermediate distribution chamber 56 to communicate with the air intake chamber and inject the compressed gas into the latter.

When the compressed gas is injected into the air intake chamber, it creates a depression which causes an inrush of atmospheric air through that opening of the intake chamber that is connected to the air intake cylinder 6.

The mixture of gas and air is then driven into the second part 38 of the main portion 26 of the ejection tube, before emerging therefrom via the end portion 28, after activating the nonreturn membrane 42, which is secured by a pin 44, in order to inflate the airbag. Said airbag (not shown) is connected with the two airbag retaining washers 14.

It will be noted that the first and second tubes, namely the central body and the ejection tube, may as an alternative be secured to one another by a bayonet mechanism, for example.

The design described hereinabove makes it possible to guarantee a simplified method of manufacturing the various component parts of the device, and for assembling or dismantling them, for example for servicing operations.

Moreover, the ejection holes 58 preferably have an inclination more or less of between 10 and 20 degrees with reference to the longitudinal direction of the device, preferably of the order of 15 degrees, and a diameter more or less of between 0.2 and 1 mm, preferably of between 0.5 and 0.8 mm.

The device advantageously comprises between 2 and 10 ejection holes, preferably between 4 and 8 and more preferably still, 6.

Figure 6:
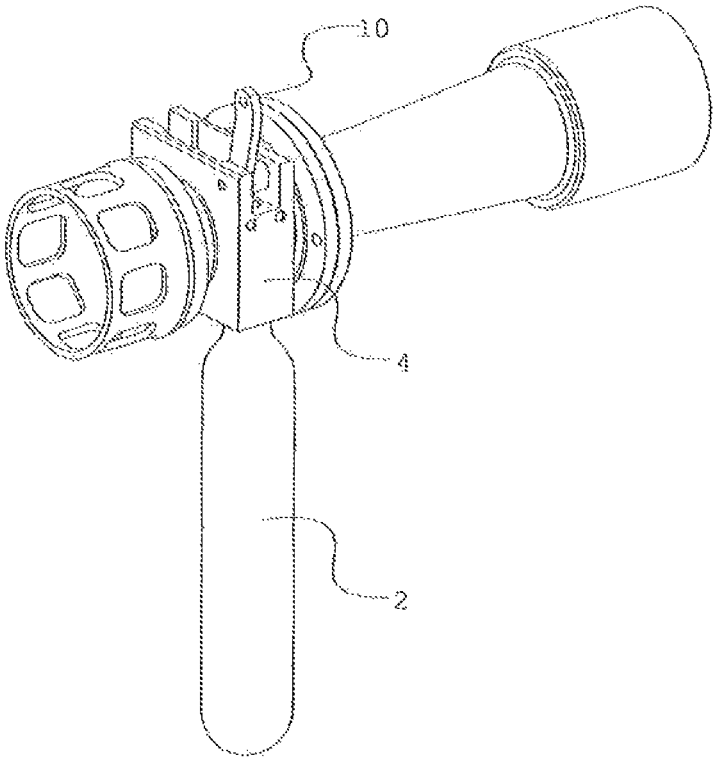
FIG. 6 is a simplified perspective view of an alternative embodiment of portable device for the rapid inflation of an inflatable bag according to the present invention

FIG. 6 is a simplified perspective view of an alternative embodiment of portable device for the rapid inflation of an inflatable bag according to the present invention. Contrary to the device of FIG. 1, the device of FIG. 6 comprises only one cartridge 2. In the specific embodiment as shown, said cartridge 2 is filled with a mixture of gas, in particular with a mixture containing substantially 65% of carbon dioxide and 35% of argon.

The device of FIG. 6 is substantially similar to the device of FIG. 1 and contains substantially the same parts. Contrary to the device of FIG. 1, to release the compressed gas only one lever 10 which is intended to be pivoted in response to an action by a user is assembled with the central body 4.

It has been shown that a multiplication factor of the order of 4 to 5 can be achieved with carbon dioxide, for an inflation time of the order of 2 to 4 seconds, even if one or two cartridges are used. A high multiplication factor makes it possible to limit fluctuations in the inflated volume of the airbag as a function of temperature, which fluctuations are connected with the thermal expansion coefficient of carbon dioxide.

The use of two small-volume cartridges rather than one cartridge of a larger volume means that the time taken to empty a cartridge can be reduced, thus reducing the risk of icing which could impair the rate at which the airbag is inflated. In particular, the smaller volume of such a cartridge has a direct influence on the consumption of energy while expanding of the gas.

Figure 7:
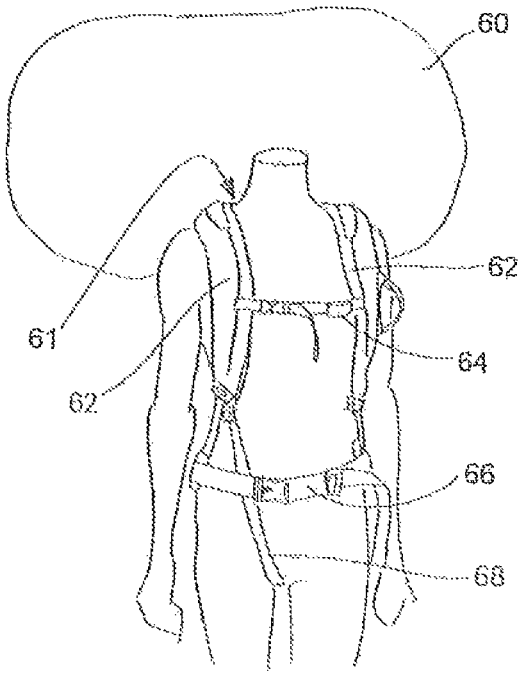
FIG. 7 is a simplified diagram of an assembly incorporating a device as illustrated in FIG. 1.
Figure 8:
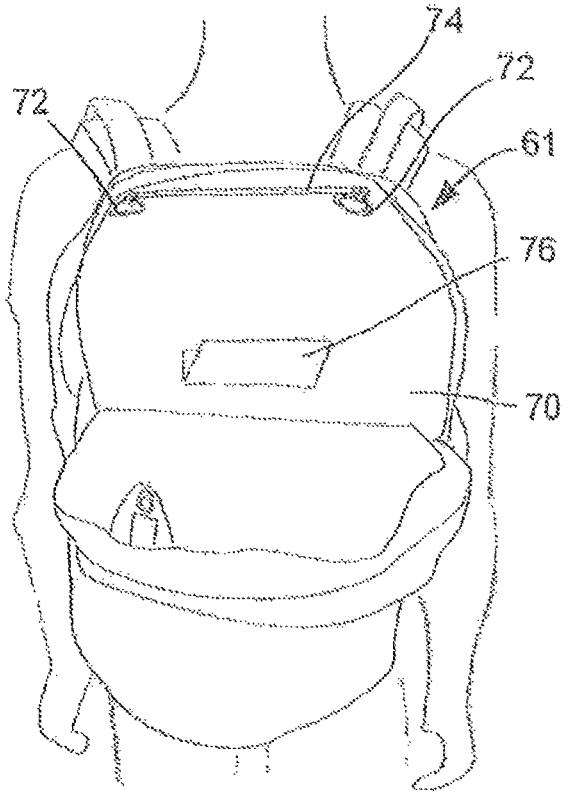
FIG. 8 is a simplified diagram of a pack intended to incorporate the assembly of FIG. 6.
Figure 9:
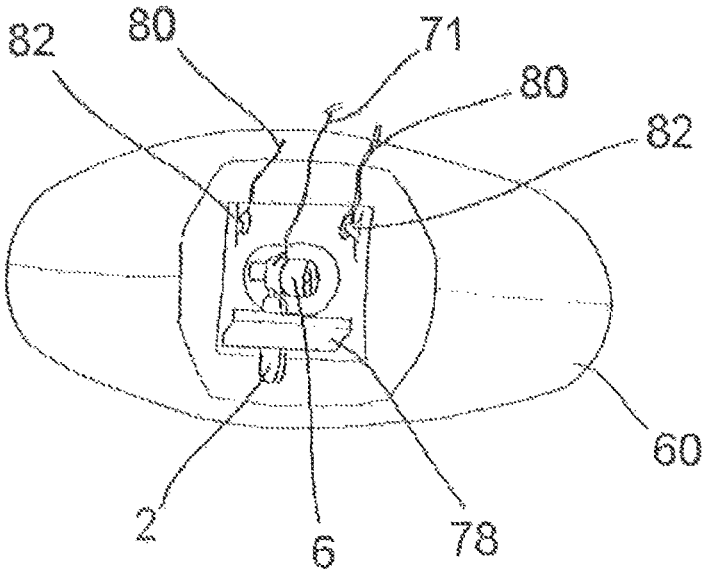
FIG. 9 is a simplified diagram of a detail of the construction of the assembly of FIG. 6.

FIGS. 7 to 9 schematically and in a simplified manner illustrate all or part of an assembly incorporating an alternative device as has just been described.

FIGS. 7 to 9 illustrate the functioning of the inflation device according to the present invention when used to inflate an avalanche airbag.

FIG. 7 illustrates the inflated airbag 60 when attached to a backpack 61 having conventional shoulder straps 62, as well as a chest strap 64, a hip belt 66 and a leg strap 68 that secures the backpack better on its wearer.

Advantageously, the airbag comprises a drain bung (not visible).

FIG. 8 illustrates a pocket 70 of the backpack 61 which pocket is intended to house the folded airbag. Advantageously, the pocket 70 may be closed by a zip-fastener of the frangible type, released by pulling a cord (numerical reference 71 in FIG. 8) connected to the levers 10 (see FIG. 1) in order to release the airbag at the moment when inflation thereof is triggered. A closure by Velcro (registered Trademark) is also conceivable.

The pocket comprises, by way of non-limiting illustration, two o-rings 72 the relative distance between which is kept fixed by a reinforcing bar 74.

Moreover, a first piece 76 of Velcro (registered trademark) is arranged in the pocket 70 and intended to collaborate with a second piece of Velcro (numerical reference 78 in FIG. 9) secured to the airbag 60.

Thus, the airbag 60 can be installed in the pocket 70 with the two pieces of Velcro engaging with one another, as is clear from FIGS. 8 and 9, before cords 80 are fitted to attach fasteners 82 of the airbag 60 to the o-rings 72. The airbag is preferably reinforced in the region of attachment of the fasteners 82 and of the inflation device.

It will be noted that the inflation device/airbag assembly forms a self-contained assembly that can easily be fitted in or removed from a backpack or transferred from one pack to another. Further, the construction of this assembly minimizes the dynamic stresses that might arise between the inflation device and the airbag and which could detract from the operational effectiveness of the assembly.

The foregoing description corresponds to a preferred embodiment of the invention which has been described nonlimitingly. In particular, the shapes depicted and described for the various constituent parts of the inflation device are not limiting.

The device according to the present invention makes it possible to create an inflation device/airbag assembly as a single unit which is at once compact, lightweight, easy to fit or remove and whose operation is safe, even in extreme conditions.

What is claimed is:

1. A portable device for inflating an avalanche airbag comprising:

at least one inlet for forming a fluid connection to a gas source, said gas source being attached or attachable to said inlet, an air intake chamber having an opening allowing atmospheric air to be admitted and an outlet intended to be connected to the airbag that is to be inflated, wherein said gas source comprises a first component and at least a gaseous second component, different from said first component, and the first component is stored in at least a partially liquid form, said gas source containing at least more than 10% of the first component, and the second component is gaseous or supercritical at a temperature of 243K and at a pressure up to 200 bar.

2. The device as claimed in claim 1, wherein said first component is carbon dioxide.

3. The device as claimed in claim 1, wherein said second component has a critical temperature below 243K.

4. The device as claimed in claim 1, further comprising a second inlet.

5. The device as claimed in claim 1, wherein said second component is selected from the following group:

nitrogen,
argon,
oxygen,
helium,
mixtures thereof.

6. The device as claimed in claim 1, wherein the gas source is at least one gas cartridge.

7. The device as claimed in claim 6, wherein the gas cartridge contains a mixture of the first and the second components.

8. The device as claimed in claim 6, wherein the first and the second components are in separate gas cartridges.

9. The device as claimed in claim 1, wherein said at least one inlet, which forms fixation means for a gas cartridge, containing compressed gas at high pressure, is associated with a mechanism that triggers the release of said compressed gas to an air intake chamber, the latter having an opening allowing atmospheric air to be admitted and an outlet intended to be connected to the airbag that is to be inflated, said inlet is associated to a gas cartridge comprising a mixture of carbon dioxide and at least one transporter gas, different from carbon dioxide, which are compressed under high pressure.

10. The device as claimed in claim 9 wherein said gas cartridge is a sealed gas cartridge.

11. The portable device as claimed in claim 9, wherein every trigger mechanism comprises a needle, said needles is controlled in a substantially simultaneous manner by a drive mechanism which can be actuated by a user so that said needles can move between at least a first position and a second position and pierce said sealed cartridge in order to release said compressed gas therefrom.

12. The device as claimed in claim 1, comprising first and second inlet, each one representing a fixation for a gas cartridge, comprising a compressed gas at high pressure, said inlet being associated with a mechanism that triggers the release of said compressed gas to an air intake chamber, the latter having an opening allowing atmospheric air to be admitted and an outlet intended to be connected to the airbag that is to be inflated, wherein said first inlet is associated to a carbon dioxide cartridge under high pressure and the second inlet is associated to a nitrogen cartridge or an argon cartridge under high pressure.

13. The device as claimed in claim 12 wherein said gas cartridge is a sealed gas cartridge.

14. The device as claimed in claim 1, wherein said gas source comprises 10% to 95% carbon dioxide.

15. The device as claimed in claim 1, wherein said gas source comprises 90% to 5% argon.

16. The device as claimed in claim 1, wherein said gas source comprises 90% to 5% nitrogen.

17. The portable device as claimed in claim 1, further comprising an intermediate distribution chamber for said compressed gases, which intermediate distribution chamber is arranged between said first and second inlets on one hand, and said air intake chamber on the other hand, said first and second inlets are in communication with said intermediate distribution chamber in such a manner that said intermediate chamber ensures a connection with the air intake chamber.

18. The portable device as claimed in claim 17 further comprising a plurality of ejection holes arranged so as to open into a lateral wall of said air intake chamber in order to connect the latter to said intermediate distribution chamber which is at least partially annular in overall shape and is arranged at the periphery of said intake chamber.

19. The portable device as claimed in claim 18, wherein said ejection holes are inclined more or less by between 10 and 20 degrees with reference to a longitudinal direction of the device.

20. The portable device as claimed in claim 18, wherein the portable device comprises between 2 and 10 ejection holes.

21. The portable device as claimed in claim 18, wherein said ejection holes have a diameter between 0.2 and 1 mm.

22. The portable device as claimed in claim 18, the ejection holes having a diameter between 0.5 and 0.8 mm.

23. The portable device as claimed in claim 18, wherein said intake chamber comprises an acceleration cone arranged between said ejection holes and said outlet.

24. The portable device as claimed in claim 17, wherein said lateral wall of said intake chamber is located between said opening and said outlet in a longitudinal direction of the device.

25. The portable device as claimed in claim 17, further comprising a first cylindrical tube the internal wall of which defines said lateral wall of said intake chamber, and a second cylindrical tube, coaxial with said first tube and arranged at least partially around it in order to define said intermediate distribution chamber therebetween at least two seals being provided to delimit said intermediate distribution chamber in a longitudinal direction of the device.

26. The portable device as claimed in claim 25, wherein the first and the second tubes are joined together by screw-fastening or by a bayonet mechanism.

27. The portable device as claimed in claim 1, wherein every said fixation means comprises a tapped thread that can be screwed together with a male screwthread provided on the sealed cartridges.

28. The portable device as claimed in claim 1, further comprising a reversible attachment member for reversible attachment to the airbag.

29. The portable device as claimed in claim 28, wherein said attachment member is distant from said outlet so that said acceleration cone can be at least partially housed in said airbag in a use configuration.

30. An assembly comprising a portable device for inflating the airbag according to one of claim 1 and the airbag, said portable device comprising an attachment member to allow said portable device to be assembled with said airbag.

31. A pack comprising the assembly as claimed in claim 30.

* * * * *